United States Patent [19]

Lorenz et al.

[11] 4,051,655

[45] Oct. 4, 1977

[54] FRICTION FALSE TWISTER

[75] Inventors: Hellmut Lorenz, Remscheid; Heino Bünger, Radevormwald, both of Germany

[73] Assignee: Barmag Barmer Maschinenfabrik Aktiengesellschaft, Remscheid-Lennep, Germany

[21] Appl. No.: 709,319

[22] Filed: July 28, 1976

[30] Foreign Application Priority Data

July 30, 1975 Germany ..... 7524158[U]
Aug. 8, 1975 Germany ..... 7525192[U]

[51] Int. Cl.[2] ..... D02G 1/04; D01H 7/92
[52] U.S. Cl. ..... 57/77.4
[58] Field of Search ..... 57/77.3–77.45

[56] References Cited

U.S. PATENT DOCUMENTS

| | | | |
|---|---|---|---|
| 3,552,112 | 1/1971 | Chabot | 57/77.4 |
| 3,901,011 | 8/1975 | Schuster | 57/77.4 |
| 3,919,833 | 11/1975 | Horvath et al. | 57/77.4 |
| 3,921,379 | 11/1975 | Smith | 57/77.4 |
| 3,964,248 | 6/1976 | Schuster | 57/77.4 |

FOREIGN PATENT DOCUMENTS

| | | | |
|---|---|---|---|
| 920,658 | 3/1963 | United Kingdom | 57/77.4 |

*Primary Examiner*—Donald Watkins
*Attorney, Agent, or Firm*—Keil, Thompson & Shurtleff

[57] ABSTRACT

In combination with a friction false twist assembly including yarn supply means to feed a synthetic filamentary polymer yarn to a friction false twisting device and yarn take-up means to collect a false twist texturized yarn from the twisting device, preferably with means to heat-set the false twisted yarn being fed to the twisting device, this invention provides an improved friction false twist element comprising an axially elongated rotational body having a sleeve hub with a plurality of disc-shaped flanges formed integrally thereon at axially spaced positions, the integral hub and flanges being made of a molded, durable and rigid plastics material, e.g. a thermosetting resin, each flange carrying a circular yarn contacting ring as a rim fastened thereto and providing a wear-resistant, roughened outer circumferential surface ideally suited to the friction twisting of the yarn. In a preferred form, the twist element is made up of a thin metallic layer onto which a wear-resistant surface layer is applied. By including a metallic powder filler in the plastic rotational body, sufficient thermal conductivity can be maintained to transfer heat away from the yarn contacting surface.

34 Claims, 15 Drawing Figures

FIG. 9a
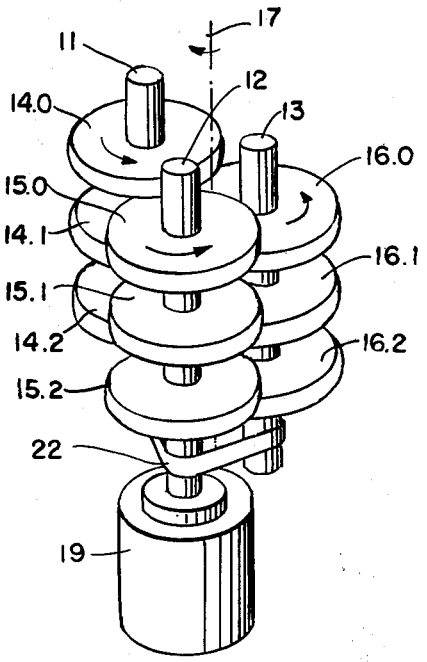
FIG. 9b
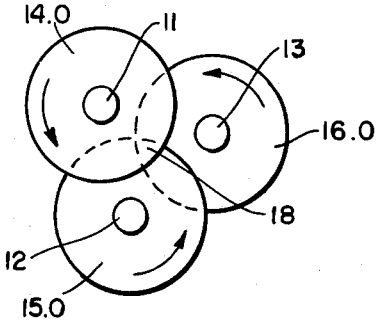
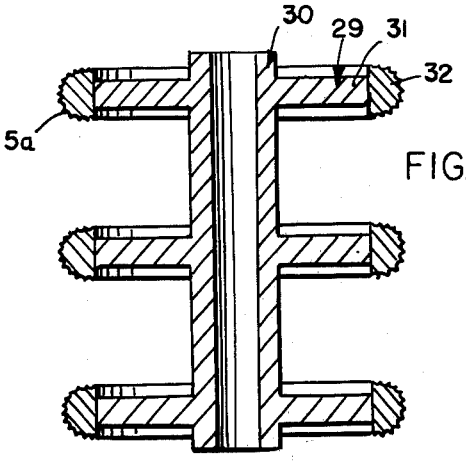
FIG. 10
FIG. 11
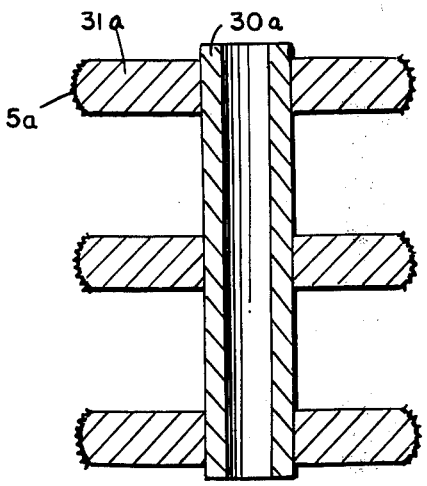
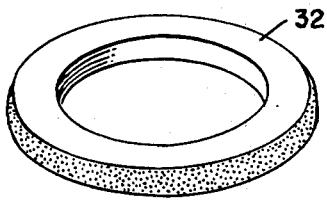
FIG. 12
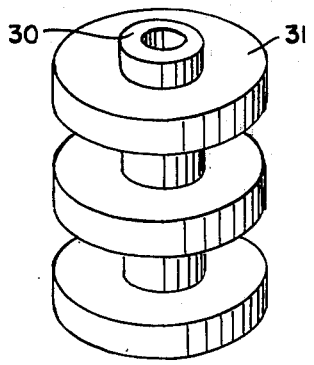
FIG. 13

FRICTION FALSE TWISTER

The production of false twist texturized yarns by means of a friction false twister is generally known, for example as discussed by Arthur and Weller, "The Principles of Friction Twisting," J. Text. Inst. 1960, Nr. 2, T 66.

An especially suitable friction false twister is shown in U.S. Pat. No. 2,923,121. This friction false twister consists of several parallel shafts which are positioned on the corners of a polygon and are driven rotatably in the same direction and with the same speed. Several discs with frictional surfaces on their circumference are mounted on these shafts and with axial spacing wherein the diameter of the discs is so large that the discs overlap at the midpoint of the polygon. The yarn path lies essentially parallel to the shafts in rubbing contact with the frictional surfaces at the midpoint of the polygon. In U.S. Pat. No. 2,923,121, individual discs are clamped onto the shafts with collars which guarantee the axial spacing.

The exact shape of such a friction false twister and its dimensional accuracy are very difficult to maintain. The quality and the uniformity of the crimped yarn suffers with this device.

An especially suitable friction false twist element is one which is composed of two or more coaxial discs connected to each other by shaft or spindle segments of much smaller diameter and made in one piece, i.e. an integral or a unitary structural element. The cost of machining this type of twist element is obviously very high due to the large quantity of metal which must be cut away as well as the accuracy which is needed in providing the precise dimensions of the twister. This high cost and difficulty in the production of such a false twister makes it desirable and even essential to renew its frictional surface as it is worn during the false twisting by the abrading contact of the running yarn. However, there is a limit to this renewal of the frictional surface, i.e. by reapplication of a new surface, because of the loss of a significant operating portion of the friction false twister, which leads to an inability to maintain exact tolerances.

It is an object of the present invention to provide an improved friction false twist element in the false twist texturizing assembly as an essentially disposable member, i.e. a one-piece friction false twister that is sufficiently simple and economical in its manufacture that it can be thrown away after a normally useful life in the texturizing apparatus.

Another problem in the manufacture of friction false twisters of the above-noted type is the preparation of the frictional surfaces which are provided on the periphery of the discs. This concerns coatings which wear as little as possible and which provide the desired frictional properties. There come into consideration coatings or layers of highly temperature resistant inorganic materials such as, e.g., carbides, nitrides, oxides, which can be brought onto the circumference of the discs by plasma spraying; metals such as chromium for example; or hard materials such as, e.g., hard metals, silicon dioxide, diamond dust and the like, which are embedded in a metal layer, e.g. nickel, as applied in this form in a liquid metal bath onto the circumference of the friction discs.

Such types of coatings are expensive. Therefore, it must be guaranteed that the coating is applied only to that portion of the surface of the friction false twister and false twist elements which come in contact with the yarn. However, if the friction false twist elements consisting of discs and axial collars are made in one piece, then it is inevitable that with the coating by plasma spraying or by immersion in a liquid bath, the axial areas of the friction false twist elements also are always coated although they never come in contact with the yarn. On the other hand, it is unfavorable for the above-mentioned reasons to clamp the individual discs onto the shaft as described in U.S. Pat. No. 2,923,121.

It is therefore a further object of the invention to manufacture a friction false twist element constructed in such a manner that a frictional surface which is applied by plasma spraying or by immersion in a liquid bath is brought solely onto the periphery of the discs and not onto the axial areas lying therebetween.

Other objects and advantages of the invention will become apparent from the following detailed specification and claims, including especially preferred embodiments of the friction false twister.

The object of this invention is essentially achieved when the friction false twist elements are constructed in multisectional form and more particularly when each element is constructed of a main body fixable for rotational symmetry on a shaft, for example as a sleeve hub which extends substantially over the length of this shaft and which has a plurality of axially spaced fits, seats or similar fastening sites adapted to receive each disc in firmly held or seated positions along the sleeve hub.

The main body or sleeve hub and the discs are preferably fastened with each other by means of a press fit.

The main body can be formed as a cylindrical hollow shaft or axle. Preferably, however, the main body has a plurality of two or more disc-shaped flanges which are formed as one piece, i.e. integrally, with the main body and which exhibit on their circumference a carefully dimensioned seating or mounting surface. On each of these round flanges, a circular ring is fastened as a friction disc exhibiting a roughened and wear-resistant surface on its outer circumference which is suitable for the friction false twisting of synthetic yarns in a false twisting process.

In one preferred embodiment, the friction false twist element is provided with a circular yarn contacting ring made up of a relatively thin metallic underlayer onto which a wear-resistant surface layer is applied. In another preferred embodiment, the circular yarn contacting ring or rim consists essentially of a sintered ceramic material having the desired roughened and wear-resistant other circumferential surface.

In an especially preferred embodiment, the circular yarn contacting ring is fastened to an integral flange and hub as the rotating body composed of thermally conductive plastics material containing a metal powder filler. In this construction, the ring or rim member is preferably composed of a heat-conducting metal, at least as the metallic underlayer, to ensure good heat dissipation during the friction false twist texturizing.

An accurate shape and good dimensional stability are achieved in the repeated use of the main body or hub if this hub is produced from a metal. If, in such a case, the discs or circulary yarn contacting rings forming these discs are also made of a metal, the coefficient of heat expansion of the hub should be equal to or greater than that of the discs.

In a further preferred embodiment, the frictional surfaces are formed by a metal coat, jacket, sheath or similar coating which contains finely divided grains or particles of a hard abrasive material (e.g. hard metal, silicon dioxide, metal oxide, carbide, diamond, etc.).

It is also advantageous in the present invention to use frictional surfaces which are formed by chromium or plasma coating.

In plasma or flame spraying, the powdered refractory or incombustible material is heated to its softening point, atomized and then sprayed in fine distribution onto the friction surface. The soft particles remain adherent onto the surface. The heating takes place by a gas flame, preferably also by means of an electrically produced plasma-arc jet. See, e.g. the Metals Handbook, Vol. II of the American Society for Metals, 1964. For this coating method, especially suitable materials are carbides, nitrides and metal oxides (e.g. $Al_2O_3$, $Cr_2O_3$).

All of the mentioned coating methods have in common that the material is brought into a soft or fluid form by spraying or in a chemical bath or a molten bath. The discs are tightly packed or stacked one on the other and led in this form into the spray apparatus or into the bath. In this manner, only the peripheral surfaces are coated aside from the cover surfaces of the first and the last discs. Thus, practically only as much material is needed as is required for coating the surfaces presented for contact with the yarn. A waste of the expensive coating material is avoided, something of particular advantage when a coating is used with a diamond powder which is embedded in a nickel layer. After the coating, the discs are separated, heated and then shrunk onto the seats which have been formed on the main body or hub. The bores in the discs on the one hand and the seats on the hub on the other hand are especially carefully made to provide a press fit, e.g. according to ISO standards. In the use of aluminum hubs and aluminum discs, the oversize of the seats on the hub should be about 40 to 60 $\mu m$ in order to equalize the heating of the discs in the operation of the friction false twister in every instance.

The invention is explained in detail with the help of the accompanying drawing in which.

FIG. 9*a* is a schematic perspective view of a friction false twister;

FIG. 9*b* is a top plan view of FIG. 9*a;*

Figure 5:
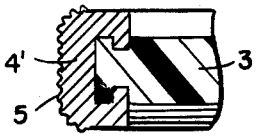
FIG. 5 is another enlarged segment of a flange and rim attached thereto by injection molding of the flange to flow into an annular hollow space of the rim.
Figure 14:
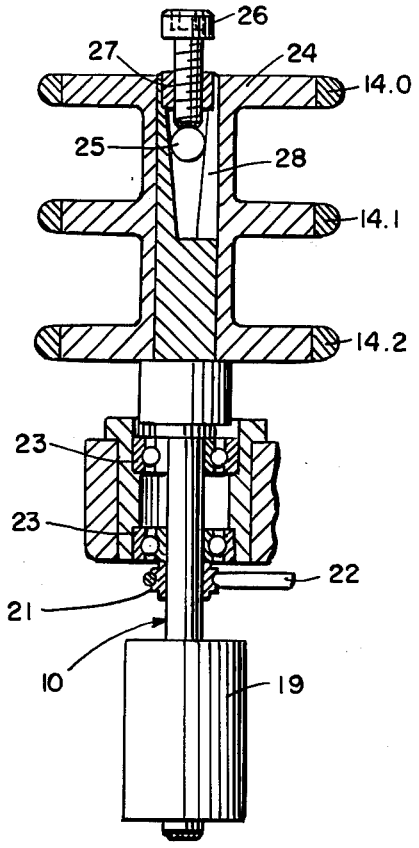

FIG. 10 is a partly schematic cross-section through the rotational axis of one embodiment of the friction false twist element constructed in accordance with this invention;

FIG. 11 is a cross-section of another embodiment;

FIG. 12 is a perspective view of a disc which is suitable to be shrunk onto the flanged hub according to FIG. 5;

FIG. 13 is a perspective view of such a flanged hub;

FIG. 14 is a partly axial cross-sectional view of the friction false twist element of the invention as mounted on a suitable shaft or spindle in accordance with the invention.

Figure 1:
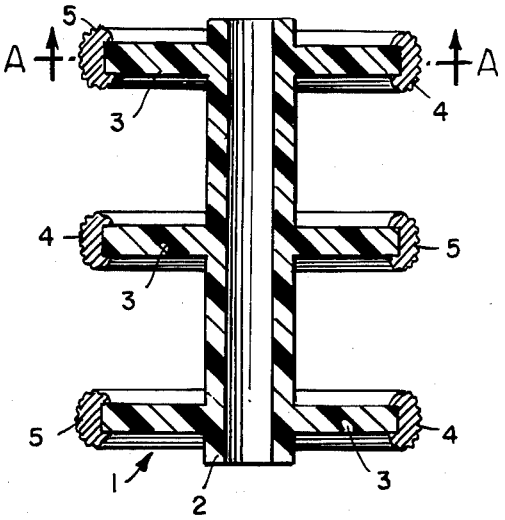
FIG. 1 is a partly schematic cross-section through the axis of rotation of one embodiment of the friction false twist element constructed in accordance with the invention.
Figure 2:
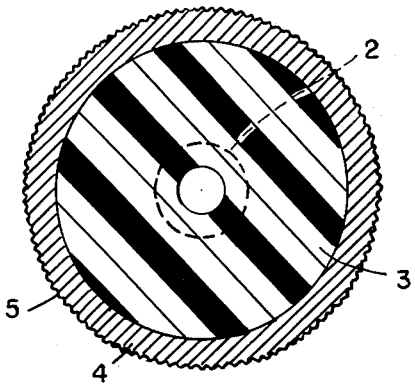
FIG. 2 is a cross-sectional view taken perpendicularly to the axis of rotation of the friction false twist element of FIG. 1 on the line A—A through one of the flanges.

Referring first to FIGS. 1 and 2, the single false twist element 1 is in the form of a rotational body consisting of the tubular portion or sleeve hub 2 and the disc-shaped flanges 3 produced as a one-piece or integral molded plastic member, for example as can be readily molded by using a thermosetting resin or polymer.

Any suitable polymer or resin may be used to mold the rotational body 1 composed of several flanges 3 on hub 2, provided that the resulting plastics body is durable, i.e. so as to be reasonably heat-resistant while remaining rigid under the operating temperatures of the texturizing process. For example, one can use polyimides which have excellent thermal stability or other more conventional thermosetting resins. Any number of thermoplastic polymers may also be used, however, especially polyamides such as nylon or special polyesters as developed by the plastics industry to provide polymers which can be injection molded and still provide resistance to high temperatures as well as good strength, rigidity and impact resistance. Furthermore, such polymers can be reinforced with glass or carbon fibers or, as especially preferred and illustrated in FIG. 7, a metal powder filler may be used in nylon or other suitable plastics to achieve good thermal conductivity of the entire rotational body.

For a detailed discussion of all such plastics materials, attention is directed to Modern Plastics Encyclopedia, Vol. 52, No. 10A, published October, 1975 (for example, see page 198 for metal powder fillers), or the more recent issues as they become available each year. A skilled plastics engineer can readily provide a large number of such moldable, durable plastics which can be very quickly and simply formed into the basic rotational body 1 demanded by the present invention.

The yarn contacting rings or rims 4 are fastened to the flanges 3 of the rotational body by molding the plastic thereto or preferably by using a metal ring or rim 4 as shown in FIGS. 1 and 2 and shrink fitting the metal ring onto the flange 3. For example, these metal rings 4 can be made of aluminum, magnesium or any other suitable metal, preferably one of the lighter metals. It is preferable to provide these metal rings of an annular thickness which is sufficient to lead off the heat developed in the friction false twist texturizing, thereby helping to prevent damage to the plastic body 1, especially if the plastics material being used is not sufficiently heat resistant itself or will not thermally stabilize itself as with a polymer containing a uniformly dispersed metal powder as a filler.

Figure 6:
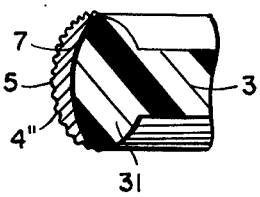
FIG. 6 is another enlarged segment in which a metallic underlayer of the rim is resin bonded to the flange.
Figure 7:
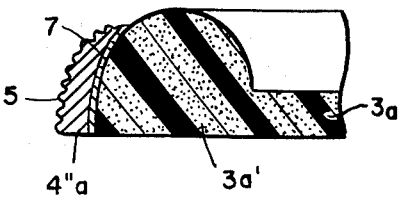
FIG. 7 is a still further enlarged and segmented view taken from FIG. 6 to illustrate still another preferred embodiment in which the flange is a thermally conducting plastic containing a metal powder filler.

As disclosed in greater detail in each of FIGS. 4 – 8, the individual rings or rims 4, 4', 4'', 4''*a*, and 8 may have a variety of shapes but they are preferably constructed with a gradually curved or elliptical outer circumferential surface as indicated in FIGS. 4, 6, 7 and 8, thereby providing a good running frictional engagement with the yarn being twisted. The flange 3 or 3*a* in FIGS. 6 and 7 is provided with a bead or enlarged knob 3' or 3'*a* at its outer end so that a relatively thin metallic underlayer 4'' or 4''*a* can be fastened by an even thinner resin bond 7. The ceramic ring 8 of FIG. 8 has an integral annular stem portion 9 which can be firmly embedded in the molded plastic flange 3.

Figure 8:
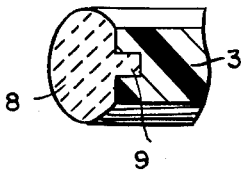
FIG. 8 is yet another enlarged segment of a flange molded to a sintered ceramic rim or ring.

Each of the rings or rims is provided with a roughened and wear-resistant outer circumferential surface 5, the ceramic ring of FIG. 8 providing its own yarn contacting surface with good friction properties. In all of the other illustrated embodiments, this outer surface 5 must be applied onto the metallic ring or underlayer by a conventional coating process. In general, it is desirable to use only ceramic or refractory types of surfaces, e.g. using the known oxide coatings such as $Al_2O_3$, $TiO_2$, $Cr_2O_3$ or the like. These are well known substances capable of forming vitrified bonds in providing bonded abrasives on grinding wheels or the like, and the same techniques of molding these materials in a high temperature firing or so-called "plasma" molding can be followed in order to initially prepare such ceramic rims or outer surfaces, the latter 5 being bonded directly onto the metallic rim members 4, etc. One can also include abrasive materials in these ceramic wear resistant surfaces to control its frictional properties to a greater degree.

These and other variations in the final outer surface structure of the friction false twist element of the invention can be readily adopted from available references such as Chemical Technology: An Encyclopedic Treatment, Vol. II, Barnes & Noble, Inc., New York (1971), pp. 150 ff. The coating of a metal surface requires only a small amount of coating or bonding material which yields the desired frictional characteristics, and this step in manufacturing the twist element is also relatively quick and inexpensive.

Figure 3:
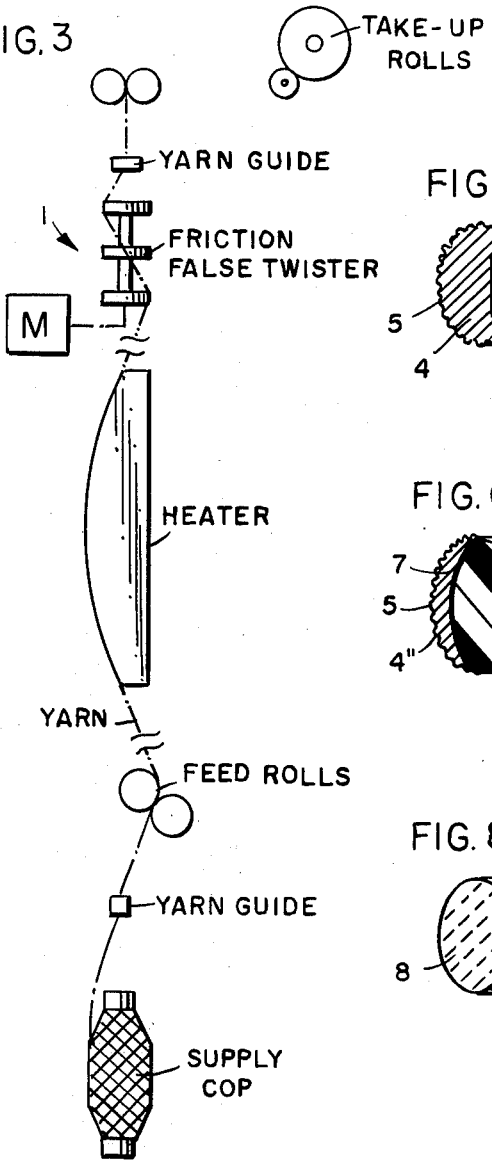
FIG. 3 is a flow sheet diagram to indicate the usual arrangement of the friction false twist element in apparatus for carrying out a false twist texturizing of a synthetic fiber-forming or filamentary polymer yarn.
Figure 4:
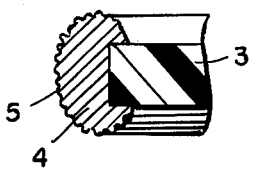
FIG. 4 is an enlarged segment taken from FIG. 1 to illustrate a circular ring or rim fastened by a shrink fit to its flange.

As indicated in FIG. 3, the friction false twister 1 is arranged in a conventional manner to receive yarn from a supply cop with the interposition of a heater to heat-set the false twisted yarn as it backs up from the false twister. An adjustable or variable speed motor M is used to adjust the rotational speed of the friction false twister 1 to achieve an optimum twisting and texturizing effect. All of the conventional thermoplastic yarns may be texturized in this apparatus, and the cost of this type of false twist texturizing is substantially reduced as a result of using the disposable friction false twist elements constructed in the manner outlined hereinabove.

The friction false twister of FIGS. 9*a* and 9*b* consists of the shafts or driven sleeves 11, 12 and 13 with their individual discs 14.0., 15.0, 16.0 on one level, discs 14.1, 15.1 and 16.1 on the next lower level and then discs 14.2, 15.2, 16.2 on the lowest level. The discs and the shafts 11, 12 and 13 are driven by motor 19 and belt 22 in the same rotational direction. The twist direction 17 of the yarn is opposite the choice of rotational direction of the discs. The yarn runs through the false twister in the region 18 in which the joint discs 14, 15 and 16 overlap (FIG. 9*b*). The shafts 11, 12 and 13 are at the points of a triangle.

FIG. 10 indicates that each friction false twist element consists of a main body 29 having the cylindrical hub 30 and the disc-shaped flanges 31 integral therewith. Such a main body can be made of synthetic material such as a thermosetting resin or thermoplastic polymer or also of metal. The friction rims are formed by the rings 32 which bear the frictional surface on their outer periphery and are constructed with a slightly curved crown in cross-section. The rings are produced from a metal. The bore of each ring forms a press fit with the seat of the flange 31 such that the heat developed during operation does not loosen the rings.

FIG. 11 illustrates another embodiment of the friction false twist element. In this case, the main body is formed only by the sleeve hub 30, shown as a cylindrical tube. The metal discs 31*a* with a wear-resistant and roughened surface coating 5*a*, as described above, is shrunk fit onto the hub 30*a*.

FIGS. 12 and 13 show the individual members of FIG. 10 in perspective, FIG. 12 showing the ring 32 with its frictional surface and FIG. 13 showing the sleeve hub 30 with its flanges 31.

FIG. 14 illustrates how a friction false twist element is fastened to its shaft in a preferred embodiment. The shaft 10 is driven by motor 19 over belt pulley 21 and belt 22 to provide a rotating spindle mount for each false twist element 24 with the bearing support 23, all of the spindles in a false twist assembly being operated by the same belt 22. The friction false twist element is represented by the rotational body 24 with discs 14.0, 14.1 and 14.2. The rims of the discs have a surface adapted to give the false twisting. The illustrated shaft 10 has a tapered bore at its upper end. This bore is threaded near the top end with adapter 27 to receive screw 26. The tapered bore becomes smaller towards the base of the shaft mounted on bearings 23. A ball 20 is positioned in the hollow space of the bore, and the shaft is slotted at 28. By turning screw 26 into the shaft, the ball 25 spreads the shaft sufficiently to cause a secure expansion clamping of the false twist element 24.

The advantage of this construction resides in the fact that only a slight torque on screw 26 is required to produce the clamping. The tolerances between the inner bore of the hub 24 and the inserted shaft 10 are so close that only a slight spreading on the shaft provides a chuck clamping effect.

The invention is hereby claimed as follows:

1. In a friction false twister for the false twist texturizing of a synthetic yarn in combination with yarn supply means and yarn take-up means, said twister including a plurality of parallel shafts, which are positioned on the corners of a polygon and rotatably driven in the same direction and at the same speed, and a plurality of discs with frictional surfaces on their peripheries, said discs being carried on each shaft in axially spaced positions and being so large in diameter that the discs on each of the parallel shafts overlap in the center of said polygon, the yarn path being substantially parallel to said shafts in frictional engagement with said disc surfaces in said center of the polygon, the improvement which comprises a sleeve hub which is adapted to be mounted on each of said rotatable shafts and to extend over substantially the length of said shaft, said hub having a plurality of axially spaced seatings for carrying said discs, each of the discs being fixed to the hub by a shrink fit on said seatings.

2. An improved friction false twist element as claimed in the combination of claim 1 wherein each of said discs has a yarn contacting ring made up of a thin metallic underlayer onto which a wear-resistant surface layer is applied.

3. A friction false twister as claimed in claim 1, the hub being composed of a molded, durable, and rigid plastics material.

4. A friction false twister as claimed in claim 1, said hub and said discs being composed of metals, the metal of said hub having a coefficient of expansion equal or greater that than of the discs.

5. A friction false twister as claimed in claim 4, said hub and said discs being composed of aluminium.

6. A friction false twister as claimed in claim 1, said frictional surfaces being a metal coat with grains of a hard material being embedded in said metal coat.

7. A friction false twister as claimed in claim 6, wherein said metal coat is nickel, said grains are diamond dust, and said coat has been applied from a liquid nickel bath in which the diamond dust is suspended.

8. A friction false twister as claimed in claim 1, said frictional surfaces being a chromium-coat being applied from a liquid chromium bath.

9. A friction false twister as claimed in claim 1, said frictional surfaces being coated by a plasma-gun-sprayed high-temperature resistant inorganic material.

10. A friction false twister as claimed in the combination of claim 1 wherein each of said discs has a yarn contacting ring consisting essentially of a sintered ceramic material having a roughened and wear-resistant outer circumferential surface.

11. A friction false twister as claimed in claim 1, wherein each shaft is radially expandable by means of a screw and a thread extending from the top of said shaft in axial direction.

12. A friction false twister as claimed in claim 11, each shaft having an axial bore extending from the top of said shaft, said bore being conical and containing an axially movable body for radially expanding said shaft, said body being pushed into said bore by said screw.

13. A friction false twister as claimed in claim 11, said shaft being slotted along said bore.

14. In a friction false twister for the false twister texturizing of a synthetic yarn in combination with yarn supply means and yarn take-up means, said twister including a plurality of parallel shafts, which are positioned on the corners of a polygon and rotatably driven in the same direction and at the same speed, and a plurality of discs with frictional surfaces on their peripheries, said discs being carried on each shaft in axially spaced positions and being so large in diameter that the discs on each of the parallel shafts overlap in the center of the said polygon, the yarn path being substantially parallel to said shafts in frictional engagement with said disc surfaces in said center of the polygon, the improvement which comprises a sleeve hub which is adapted to be mounted on each of said rotatable shafts and to extend over substantially the length of said shaft, said hub having a plurality of said axially spaced annular discs mounted thereon and each of said shafts being axially expandable with means extending from the top of said shaft in axial direction to radially expand the shaft.

15. A friction false twister as claimed in claim 14, wherein each shaft is radially expandable by means of a screw and a thread extending from the top of said shaft in axial direction.

16. A friction false twister as claimed in claim 14, each shaft having an axial bore extending from the top of said shaft, said bore being conical and containing an axially movable body for radially expanding said shaft, said body being pushed into said bore by said screw.

17. A friction false twister as claimed in claim 14, said shaft being slotted along said bore.

18. In a friction false twister for the false twist texturizing of a synthetic yarn in combination with yarn supply means and yarn take-up means, said twister including a plurality of parallel shafts, which are positioned on the corners of a polygon and rotatably driven in the same direction and at the same speed, and a plurality of discs with frictional surfaces on their peripheries, said discs being carried on each shaft in axially spaced positions and being so large in diameter that the discs on each of the parallel shafts overlap in the center of said polygon, the yarn path being substantially parallel to said shafts in frictional engagement with said disc surfaces in said center of the polygon, the improvement which comprises a sleeve hub which is adapted to be mounted on each of said rotatable shafts and to extend over substantially the length of said shaft; and a plurality of disc-shaped flanges integral with said hub and arranged at axially spaced intervals to extend radially of said hub, each said flange acting as a seating to initially receive an annular disc with a press fit on its periphery, whereby each of the discs provides a circular yarn contacting ring fixed as a rim around each of said disc-shaped flanges and including a roughened and wear-resistant outer circumferential surface suitable for the friction twisting of said synthetic yarn during said false twist texturizing.

19. A friction false twister as claimed in claim 18 wherein each of said yarn contacting rings is fixed on its disc-shaped flange by a shrink fit.

20. A friction false twister as claimed in claim 19 wherein said integral hub and flanges and said yarn contacting rings are composed of metals, the metal of said hub having a coefficient of expansion equal or greater than that of the yarn contacting rings.

21. A friction false twister as claimed in claim 19 wherein said integral hub and flanges and said yarn contacting rings are composed of aluminium.

22. An improved friction false twist element as claimed in the combination of claim 18 wherein the yarn contacting ring is made up of a thin metallic underlayer onto which a wear-resistant surface layer is applied.

23. A friction false twister as claimed in the combination of claim 22 wherein said thin metallic underlayer is resin-bonded onto the flange.

24. A friction false twister as claimed in claim 18 wherein said integral hub and flanges are composed of a molded, durable, and rigid plastics material.

25. A friction false twister as claimed in combination of claim 24 wherein a thin metallic underlayer is fixed to the flange by molding the flange thereto.

26. An improved friction false twist element as claimed in the combination of claim 24 wherein said integral hub and flanges of the rotational body are made of a thermally conductive plastics material containing a metal powder filler.

27. A friction false twister as claimed in claim 18, said frictional surfaces being a metal coat with grains of a hard material being embedded in said metal coat.

28. A friction false twister as claimed in claim 27, wherein said metal coat is nickel, said grains are diamond dust, and said coat has been applied from a liquid nickel bath in which the diamond dust is suspended.

29. A friction false twister as claimed in claim 18, said frictional surfaces being a chromium-coat being applied from a liquid chromium bath.

30. A friction false twister as claimed in claim 18, said frictional surfaces being coated by a plasma-gun-sprayed inorganic high-temperature resistant material.

31. A friction false twister as claimed in the combination of claim 18 wherein the yarn contacting ring consists essentially of a sintered ceramic material having a roughened and wear-resistant outer circumferential surface.

32. A friction false twister as claimed in claim 18, wherein each shaft is radially expandable by means of a screw and a thread extending from the top of said shaft in axial direction.

33. A friction false twister as claimed in claim 32, each shaft having an axial bore extending from the top of said shaft, said bore being conical and containing an axial movable body for radially expanding said shaft, said body being pushed into said bore by said screw.

34. A friction false twister as claimed in claim 32, said shaft being slotted along said bore.

* * * * *

UNITED STATES PATENT OFFICE

CERTIFICATE OF CORRECTION

Patent No. 4,051,655 Dated October 4, 1977

Inventor(s) Hellmut Lorenz et al.

It is certified that error appears in the above-identified patent and that said Letters Patent are hereby corrected as shown below:

Column 7, line 37, "twister", second occurrence, should read -- twist --.

Column 8, line 36, "19" should read --20 --.

Signed and Sealed this

Sixteenth Day of May 1978

[SEAL]

Attest:

RUTH C. MASON
Attesting Officer

LUTRELLE F. PARKER
Acting Commissioner of Patents and Trademarks

UNITED STATES PATENT AND TRADEMARK OFFICE

CERTIFICATE OF CORRECTION

PATENT NO. : 4,051,655

DATED : October 4, 1977

INVENTOR(S) : Lorenz et al

It is certified that error appears in the above-identified patent and that said Letters Patent are hereby corrected as shown below:

Column 7, line 4, "that than" should be corrected to read --than that--.

Signed and Sealed this

*First* Day of *August 1978*

[SEAL]

*Attest:*

RUTH C. MASON
*Attesting Officer*

DONALD W. BANNER
*Commissioner of Patents and Trademarks*